United States Patent [19]

Brackmann et al.

[11] Patent Number: 4,459,999

[45] Date of Patent: Jul. 17, 1984

[54] CIGARETTE MAKER FEEDER

[75] Inventors: Warren A. Brackmann, Cooksville; Karel Hrboticky, Etobicoke, both of Canada

[73] Assignee: Rothmans of Pall Mall Canada Limited, Don Mills, Canada

[21] Appl. No.: 313,797

[22] Filed: Oct. 22, 1981

[30] Foreign Application Priority Data

Oct. 23, 1980 [GB] United Kingdom ..... 8034240

[51] Int. Cl.[3] ..... A24B 3/06; A24C 5/39

[52] U.S. Cl. ..... 131/109 R; 131/110

[58] Field of Search ..... 406/62; 131/109 B, 109 R, 131/110, 84 B, 84 R, 108

[56] References Cited

U.S. PATENT DOCUMENTS

| | | | |
|---|---|---|---|
| 856,109 | 6/1907 | Stoetzel | 406/62 |
| 1,679,557 | 8/1928 | Bailey | 406/62 |
| 1,724,319 | 8/1929 | Schünemann | 131/109 R |
| 2,886,216 | 5/1959 | Öholm | 406/62 |
| 2,917,344 | 12/1959 | Futty | 406/62 |
| 3,138,163 | 6/1964 | Ffoulkes | 131/110 |
| 3,276,452 | 10/1966 | Dearsley | 131/109 R |
| 3,362,414 | 1/1968 | Wochnowski | 131/110 |
| 3,386,773 | 6/1968 | Ballard, Jr. | 406/16 |
| 3,409,025 | 11/1968 | Wochnowski | 34/46 |
| 3,450,311 | 6/1969 | Bonnéric | 131/108 |
| 3,561,823 | 2/1971 | Meuret | 406/62 |
| 3,578,814 | 5/1971 | Todd | 406/62 |
| 3,580,644 | 5/1971 | Ballard, Jr. | 131/110 |
| 3,667,814 | 6/1972 | Krivda | 406/62 |
| 4,135,615 | 1/1979 | Brackmann et al. | 131/108 |
| 4,175,570 | 11/1979 | Heitmann | 131/84 B |
| 4,223,685 | 9/1980 | Labbè | 131/109 R |
| 4,259,032 | 3/1981 | Kuhner | 406/62 |
| 4,264,238 | 4/1981 | Leckband et al. | 406/62 |

FOREIGN PATENT DOCUMENTS

| | | | |
|---|---|---|---|
| 1285929 | 12/1968 | Fed. Rep. of Germany | 131/110 |

*Primary Examiner*—Vincent Millin
*Assistant Examiner*—Harry J. Macey
*Attorney, Agent, or Firm*—Sim & McBurney

[57] ABSTRACT

A novel tobacco feed device (10) and method of use thereof for the direct feed of tobacco to rod formation in a cigarette making machine are described. The device (10) includes a reservoir tube (42) containing a reservoir of opened cut tobacco, metering rolls (54) to meter required amounts of cut tobacco from the reservoir tube (42) to discharge metered tobacco to the cigarette maker. Internal hoppers, carding drums and picker wheels are avoided by the structure of the invention giving rise to greatly enhanced tobacco filling power.

9 Claims, 1 Drawing Figure

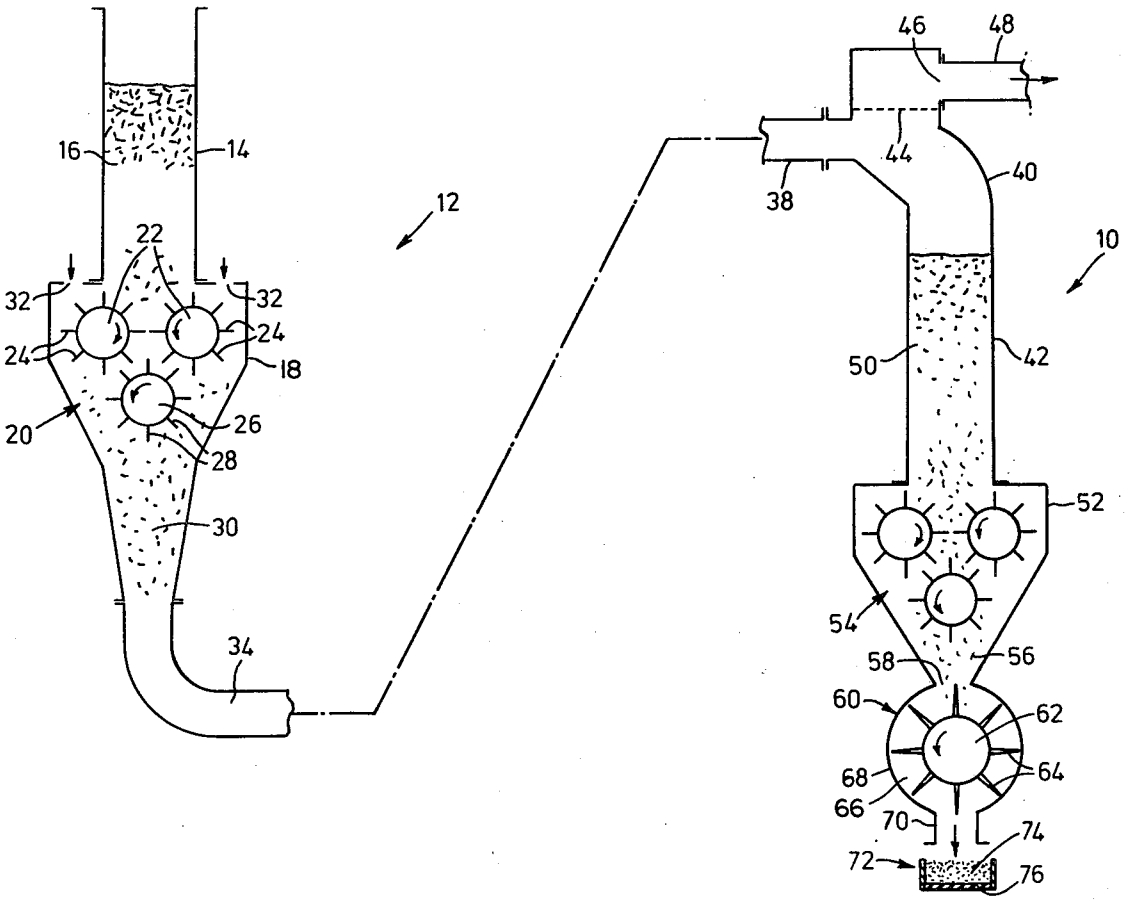
10
12
14
16
18
20
22
24
26
28
30
32
34
38
40
42
44
46
48
50
52
54
56
58
60
62
64
66
68
70
72
74
76

CIGARETTE MAKER FEEDER

FIELD OF INVENTION

The present invention relates to a feeding mechanism for feeding cut tobacco to a cigarette rod maker.

BACKGROUND TO THE INVENTION

In the manufacture of cigarettes, a shower of tobacco particles flows onto a rod-forming surface travelling transversely of the shower to form a tobacco rod which is wrapped in a paper band to form a cigarette rod from which individual cigarettes are severed.

The shower may be fed directly onto the rod-forming surface or first onto a series of vacuum wheels to form tobacco substreams from which the rod is assembled. The shower is formed from a metered feed of cut tobacco particles, the metered feed resulting from a reservoir of tobacco particles in a hopper associated with the cigarette making machine.

The metered feed traditionally has been formed by rotating a carding drum in a mass of tobacco to pick up tobacco particles on the carded surface, removing excess tobacco by a counter-rotating second carding drum or refuser roll, and picking the tobacco particles from the surface of the carding drum. The mass of tobacco is provided by an initial metering of tobacco from the reservoir using an elevator device and a refuser device and a refuser roll to control the flow.

The use of carding drums as outlined above leads to degradation of the tobacco as a result of tobacco refusal, in turn decreasing the filling power of the tobacco. The filling power of tobacco is the ability of the tobacco to fill a cigarette paper tube to a desired hardness value, the less tobacco required to achieve that hardness the greater the filling power of the tobacco.

More recently, an improvement in this prior art system has been developed wherein tobacco is positioned in a column metering tube which has a rotating roller located at the lower end to control the rate of flow of tobacco. A picking roller is located adjacent the metering roller to remove the tobacco particles from the surface thereof. While the latter procedure avoids the degradation of tobacco associated with the refusal of tobacco by the carding drums, nevertheless tobacco degradation arises from the utilization of the picker roll.

SUMMARY OF INVENTION

In accordance with the present invention, there is provided a novel tobacco feeder device which provides a precise feed of the desired quantity of tobacco to rod formation, so as to eliminate any necessity for refusal of tobacco within the cigarette making machine and also eliminates the tobacco degradation associated with the prior art procedures. The feeder device of this invention communicates directly with rod formation, thereby eliminating the necessity for premetering devices and carding drums and/or metering tubes.

The present invention, in its broadest aspect, comprises a procedure for the formation of a feed of tobacco particles suitable for assembly of a tobacco filler rod therefrom by metering tobacco from a reservoir of tobacco at a flow rate required for filler rod formation to form a feed stream of substantially separated tobacco particles. This procedure may be accomplished using an upright reservoir tube which contains cut tobacco received from a source thereof and metering rollers positioned at the lower end of the reservoir tube to meter the tobacco at the desired rate from the tube to form the feed.

The present invention also includes a novel method of forming a tobacco filler rod utilizing the procedure of the invention and also a novel cigarette making machine comprising a filler rod forming mechanism, the reservoir tube and metering rollers.

BRIEF DESCRIPTION OF DRAWING

The sole FIGURE of the drawing is a schematic representation of a preferred embodiment of the invention.

DESCRIPTION OF PREFERRED EMBODIMENTS

Referring to the drawing, there is illustrated therein a novel cut tobacco feeder device 10 shown in conjunction with a tobacco metering and conveying system 12. The tobacco metering and conveying system 12 forms the subject of copending U.S. patent application Ser. No. 168,505 filed July 14, 1980, under the title "TOBACCO METERING AND FEEDING SYSTEM" in the name of Warren A. Brackmann and assigned to the assignee of this application, and the disclosure of said copending application is incorporated herein by reference.

The tobacco metering and conveying system 12 includes a reservoir tube 14 in which cut tobacco 16 is positioned for metering and conveying. The reservoir 14 at its lower end communicates with a housing 18 wherein are located a set of rollers 20 arranged for rotation about parallel horizontal axes. The set of rollers 20 includes a horizontally-spaced pair of rollers 22 located immediately below the lower opening to the tube 14 to receive tobacco in the gap between the rollers 22. The left-hand side roller 22 (as viewed in the drawing) is arranged to rotate in a clockwise direction while the right-hand side roller 22 is arranged to rotate in an anti-clockwise direction. The surfaces of the rollers 22 include a plurality of radial projections 24 which cooperate in the gap between the rollers 22 to meter the desired quantity of tobacco from the tube 14. The quantity of tobacco metered from the tube 14 by the rollers 22 may be varied by varying the speed of rotation of the rollers.

The set of rollers 20 also includes a third roller 26 located below the rollers 22. The third roller 26 may be rotated in either direction and includes a plurality of radial projections 28 which open the tobacco which is metered through the gap between the rollers 22 so as to form a plurality of individual separated tobacco particles 30 falling in the housing 18 below the roller 26.

A set of rollers suitable for use as the set of rollers 20 is described and illustrated in detail in U.S. Pat. No. 4,135,615, assigned to the assignee of this application, the disclosure of which is incorporated herein by reference.

Openings 32 are located in the wall of the housing 18 to permit air to be drawn into the housing 18 as described in more detail below. The housing 18 communicates at its lower end with one end of a tobacco conveying pipe 34 which extends therefrom to the feeder device 10. The metering and conveying system 12 hence is constituted by a metering and opening device and a tobacco conveying pipe.

The feeder device 10 includes a horizontal entrance pipe 38 which projects the air-conveyed tobacco into an upper curved pipe 40 which communicates at its lower end with a tobacco reservoir tube 42.

An air-permeable and tobacco-impermeable screen 44 is located above the entrance pipe 38 and separates the interior of the pipe 40 from an upper exit 46 which communicates with a source of vacuum (not shown) through pipe 48. The screen 44 serves to separate the air and tobacco entering the feeder device 10, as described in more detail below.

The tobacco reservoir tube 42 receives the conveyed tobacco therein to provide a reservoir 50 of tobacco particles for feed to a cigarette maker. The reservoir tube 42 communicates at its lower end with a housing 52 wherein are located a set of rollers 54. The set of rollers 54 may be arranged and constructed in the same manner as the set of rollers 20 described in detail above. A set of rollers suitable for use as the set of rollers 54 is described and illustrated in the aforementioned U.S. Pat. No. 4,135,615. The set of rollers 54 meters tobacco from the reservoir 50 and then opens the tobacco to form a plurality of individual separated particles 56 falling in the housing 52 towards the lower end thereof.

At its lower end, the housing 52 communicates with the inlet 58 of a rotary air lock 60 which has a rotor 62 with radial blades 64 which define between arcuately-adjacent pairs thereof elongate tobacco receiving and conveying compartments 66. The radial blades 64 project into sealing engagement with part-circular walls 68 of the air lock 60. The lower outlet 70 of the rotary air lock 60 is open to atmosphere and communicates directly with the rod forming mechanism of a cigarette-making machine, shown schematically at 72.

The rotary air lock 60 may be constructed as described and illustrated in U.S. Pat. No. 4,259,032, assigned to the assignee of this application, the disclosure of which is incorporated herein by reference. Any other similar rotary air lock structure may be employed.

The feeder device 10 provides tobacco feed for a single cigarette making machine. In a plant, a plurality of such devices would be provided for individually feeding a plurality of machines.

OPERATION

In operation, vacuum is continuously applied through pipe 48 to the conveying pipe 34, and, under the influence of this vacuum, air is drawn through the openings 32 to the housing 18 and through the pipe 34.

Tobacco is metered from the reservoir tube 14 by the pair of rollers 22 and is opened by the roller 26 to form a plurality of separated tobacco particles entering the conveying pipe 34. The quantity of tobacco which is metered from the reservoir tube 14 in this way usually is that required to respond to the requirements of the metering tube 42, which in turn, is that required to respond to cigarette-making machine feed requirements. The separated individual tobacco particles 30 are air conveyed in the air stream flowing through pipe 34 to the feeder device 10.

As the mixture of air and tobacco enters the curved pipe 40 through entrance pipe 38, separation of tobacco from air occurs. The air is drawn upwardly through the screen 44 and out of the feeder device 10 under the influence of the vacuum applied through pipe 48. The screen 44 serves to prevent tobacco particles from exiting with the air stream.

The separated tobacco particles fall into the reservoir tube 42. While some compaction of the tobacco particles may occur in the reservoir 50, the particles remain in substantially separated form, the primary separation of the individual tobacco particles one from another having been achieved by the set of rollers 20 at the source of the cut tobacco.

The set of rollers 54 meter and open the tobacco in the reservoir 50 in similar manner to that described in connection with tobacco received at the set of rollers 20 from the reservoir tube 14. However, the force required to be exerted on the tobacco by the set of rollers 54 to achieve those functions is generally considerably less than is required to be applied by the set of rollers 20, since, as noted above, the functions of opening and metering the tobacco have been primarily achieved by the set of rollers 20 and little compaction of the tobacco occurs in the reservoir tube 42.

The wide shower of separated particles 56 resulting from the actions of the set of rollers 54 fall through the inlet 58 to the air lock 60 and thence into the compartments 66 between the blades 64 of the rotor 62. The tobacco in the compartments 66 is conveyed by rotation of the rotor 62 from the vacuum environment at the inlet 58 to the atmospheric pressure environment at the outlet 70 from the air lock 60. The conveyed tobacco falls out of the outlet 70 into the rod-forming mechanism of the cigarette-making machine. Tobacco is built up to form a filler rod 74 on a rod conveying surface 76.

In the tobacco metering and conveying system 12, the air flow through the pipe 34 is continuous, although the conveyance of tobacco by the continuous air flow may be, and often is, discontinuous in character. Only the amount of tobacco required by the reservoir 50 at any given time is metered from the reservoir 14 and opened into the flowing air stream in pipe 34. The tobacco which is conveyed through the pipe 34 ultimately is discharged through the rotary air lock 60, so that air flow need not cease in order to permit tobacco discharge.

As described in the aforementioned copending U.S. patent application Ser. No. 168,505, the continuous air flow through the conveying pipe 34, which results from the unique combination of structural elements in the tobacco metering and conveying system 12, permits a much lower air flow rate and consequently lower tobacco particle flow rate, to be utilized than has heretofore been the case. Tobacco degradation and consequent loss of filling power resulting from higher speed tobacco flow rates, therefore, are avoided.

Although it is preferred to utilize the metering and conveying system 12 in conjunction with the feeder device 10, in view of the benefits to be gained thereby as outlined above, the tobacco reservoir 50 may be obtained from any other convenient source of cut tobacco which is able to provide tobacco particles thereto.

For example, the tobacco may be fed to the reservoir tube 42 using a conventional air conveying system, which feeds the tobacco from a remote source thereof to a lock hopper. When the desired amount of tobacco has accumulated in the lock hopper, then the flow of conveying air to the lock hopper is ceased and the hopper opened to dump the accumulated tobacco into the reservoir tube 42.

The tobacco which is received in the reservoir tube 42 is metered therefrom in the amount required at any given time by the rod-forming mechanism of the cigarette maker. Since the tobacco is discharged through the outlet 70 of the air lock 60 in clumps from the compartments 66, an averaging device, such as, a vibrating conveyor (not shown) may be used to ensure uniformity in the tobacco feed to the tobacco rod-forming mechanism 72.

The air lock 60 is employed in the device illustrated in the drawing since the reservoir tube 42 is maintained under a vacuum and it is necessary to convey the tobacco from the vacuum environment thereof to an atmospheric pressure environment without breaking the vacuum. However, where the present invention is utilized with a tobacco feeding system which does not impart a subatmospheric pressure to the reservoir tube 42, such as the lock hopper mentioned above, then the air lock is not required, but rather the tobacco is metered directly out of the reservoir 50 by the rollers 54 to the rod forming mechanism.

The tobacco feed is made directly from the tobacco feeder device 10 to the rod-forming mechanism of the cigarette making machine. This direct feed may take the form of showering tobacco particles directly onto the rod forming surface or, alternatively, the tobacco feed may be showered first onto an indirect rod-forming mechanism involving the initial formation of tobacco substreams from the tobacco feed from the tobacco feed device 10 and the subsequent assembly of the tobacco rod from the substreams. The latter procedure is described in detail in U.S. Pat. No. 3,989,052, assigned to the assignee of this application and the disclosure of which is incorporated herein by reference. In either case, it is the tobacco feeder device 10 which provides the tobacco feed directly to rod formation and no storage hopper and metering device is required within the cigarette making machine.

Since the quantity of tobacco required for rod making within the cigarette making machine is fed to rod formation by the feeder device 10, the necessity for the refuser rolls of the prior art or other form of tobacco recycling is avoided and hence the tobacco degradation associated therewith is minimized. By using the tobacco metering and conveying system 12 in conjunction with the feeder device 10, further tobacco degradation associated with tobacco conveying can be avoided.

In addition, the necessity for carding drums and/or picking rolls to form the tobacco feed to the rod-making mechanism within the cigarette making machine is avoided by the present invention.

SUMMARY

In summary of this disclosure, the present invention provides a novel tobacco feeding system for a cigarette making machine which enables tobacco degradation to be avoided and filling power to be maintained. Modifications are possible within the scope of this invention.

What we claim is:

1. A method for providing a feed of tobacco for a cigarette making machine, which comprises:

feeding cut tobacco downwardly from a source of unopened cut tobacco between counterrotating metering rollers to form a metered flow of cut tobacco particles, contacting said metered flow with mechanical opening means to open said metered flow and separate the tobacco particles in said metered flow one from another, feeding all said separated tobacco particles into a flowing air stream passing through an enclosed tobacco feed conduit extending continuously from said source of unopened cut tobacco to a second location, conveying by said flowing air stream all said fed cut tobacco particles in substantially separated condition to a reservoir at said second location, separating said conveyed tobacco particles from said air stream at said second location, collecting said separated tobacco particles in said reservoir, and metering tobacco particles from said reservoir to form said feed.

2. The method of claim 1 wherein said reservoir is located in a subatmospheric pressure environment and said metered particles are discharged from said subatmospheric pressure environment to form said feed in an atmospheric pressure environment while maintaining said subatmospheric pressure environment.

3. A method of forming a tobacco filler rod, which comprises:

feeding cut tobacco downwardly from a source of unopened cut tobacco between counterrotating metering rollers to form a metered flow of cut tobacco particles, contacting said metered flow with mechanical opening means to open said metered flow and separate the tobacco particles in the metered flow one from another, feeding all said separated tobacco particles into a flowing air stream passing through an enclosed tobacco feed conduit extending continuously from said source of unopened cut tobacco to a second location, air conveying by said flowing air stream all said fed cut tobacco particles in a substantially separated condition to a reservoir at said second location, collecting said conveyed particles directly from said conveying air stream in said reservoir, metering cut tobacco particles from said reservoir thereof at a flow rate required for filler rod formation to form a feed of substantially separated tobacco particles in a form suitable for tobacco filler rod formation, and forming said tobacco filler rod directly from said feed of tobacco particles.

4. The method of claim 3, wherein said reservoir is located in a subatmospheric pressure environment and said feed is discharged from said subatmospheric pressure environment to an atmospheric pressure environment while maintaining said subatmospheric pressure environment.

5. An apparatus for forming a feed of tobacco for a cigarette making machine, comprising:

a tobacco metering and conveying apparatus to meter tobacco from a reservoir thereof, separate the metered tobacco into separate particles and air convey the separated particles to a tobacco reservoir means for holding a reservoir of cut tobacco, tobacco and air separating means for separating said tobacco particles and the air conveying stream at said reservoir means, metering means located in fluid flow communication with said reservoir means for metering cut tobacco from said reservoir thereof, opening means for opening cut tobacco metered by said metering means, and tobacco conveying means located in fluid flow communication with said opening means for receiving opened tobacco and for conveying the opened tobacco to an outlet thereof, said tobacco conveying means comprising a rotary air lock means having an upper inlet in communication with said opening means, a rotor having radially-projecting vanes extending into sealing engagement with facing arcuate walls, thereby defining tobacco conveying compartments between arcuately-adjacent pairs of vanes, and a lower outlet for discharge of tobacco conveyed by said tobacco conveying compartments.

6. A cigarette-making machine, comprising:

means for providing a feed of tobacco particles in a substantially separated condition to a transversely-elongate, laterally-thin upright reservoir vessel means for holding a reservoir of cut tobacco in substantially separated form, said reservoir vessel means having open upper and lower ends, tobacco metering means in fluid flow communication with the lower end of said reservoir vessel means for metering tobacco from said lower end across the whole width thereof and for providing the metered tobacco in a substantially separated condition in the form of a transversely-wide, laterally-thin falling stream suitable for formation of a tobacco filler rod therefrom, said tobacco metering means comprising a pair of horizontally-spaced rollers located at the lower end of said reservoir means arranged for rotation about parallel axes to meter tobacco from the lower end of said reservoir vessel and a third roller located below and equidistantly from the axes of the pair of rollers for unidirectional rotation about an axis parallel to the axes of said pair of rollers to open the metered tobacco and provide said metered tobacco in a substantially separated condition, and filler rod-forming means including a filler rod-forming surface movable longitudinally across the width of the falling tobacco stream.

7. A cigarette-making machine, comprising:

a transversely-elongate, laterally-thin upright reservoir vessel means for holding a reservoir of cut tobacco and having open upper and lower ends;

tobacco metering and feeding means in communication with said upper end of said reservoir vessel means, said tobacco metering and feeding means comprising:

tobacco metering means for metering cut tobacco from a reservoir thereof, tobacco opening means for opening the metered tobacco to provide said cut tobacco in substantially separated form, conduit means extending from said tobacco opening means to said reservoir vessel means, vacuum inducing means in communication with said conduit means adjacent said reservoir vessel means for drawing air through said conduit means thereby to convey therethrough the opened cut tobacco received into said conduit means, and tobacco/air separator means located at said upper end of said reservoir vessel means for separating the air drawn through said conduit means from the tobacco conveyed thereby, whereby the conveyed tobacco enters said reservoir vessel means to form said reservoir of cut tobacco therein;

tobacco metering means in fluid flow communication with the lower end of said reservoir vessel means for metering tobacco from said lower end across the whole width thereof and for providing the metered tobacco in a substantially separated condition in the form of a transversely-wide, laterally-thin falling stream suitable for formation of a tobacco filler rod therefrom, said tobacco metering means comprising a pair of horizontally-spaced rollers located at the lower end of said reservoir vessel means arranged for rotation about parallel axes to meter tobacco from the lower end of said reservoir vessel and a third roller located below and equidistantly from the axes of the pair of rollers for rotation about an axis parallel to the axes of said pair of rollers to open the matered tobacco and provide said metered tobacco in a substantially separated condition; and filler rod-forming means including a filler rod-forming surface movable longitudinally across the width of the falling tobacco stream.

8. The cigarette making machine of claim 7 wherein said conduit means terminates in a horizontally-directed pipe, said horizontally-directed pipe communicates with a downwardly-curved pipe integrally formed with the upper end of said reservoir vessel, said tobacco/air separator means comprises an air permeable and tobacco impermeable screen located in one wall of said downwardly-curved pipe at the inlet end thereof, and said vacuum inducing means communicates with the downstream side of said screen.

9. The cigarette making machine of claim 7 or 8, including continuous vacuum air lock means between said reservoir vessel means and said filler rod forming means to enable tobacco to be discharged from said reservoir vessel without interrupting the flow of air through said conduit means.

* * * * *